United States Patent [19]

Ciarcia et al.

[11] Patent Number: 4,679,016

[45] **Date of Patent: * Jul. 7, 1987**

[54] INTERCHANGEABLE MECHANISM FOR MOLDED CASE CIRCUIT BREAKER

[75] Inventors: Ronald D. Ciarcia, Southington; Gregory T. DiVincenzo; Richard E. Bernier, both of Plainville; Joseph G. Nagy, New Britain, all of Conn.

[73] Assignee: General Electric Company, New York, N.Y.

[ * ] Notice: The portion of the term of this patent subsequent to Nov. 11, 2003 has been disclaimed.

[21] Appl. No.: 817,213

[22] Filed: Jan. 8, 1986

[51] Int. Cl.[4] ..... H01H 67/02

[52] U.S. Cl. ..... 335/132; 200/153 G; 335/9; 335/23; 335/35; 335/38; 335/172

[58] Field of Search ..... 335/22–24, 335/35, 172, 132, 189–191, 8–10, 37–40; 200/153 G, 281

[56] References Cited

U.S. PATENT DOCUMENTS

| | | | |
|---|---|---|---|
| 3,317,867 | 5/1967 | Powell | 335/172 |
| 3,384,845 | 5/1968 | Johnson et al. | 335/23 |
| 3,849,751 | 11/1974 | Link et al. | 200/153 G X |
| 4,166,988 | 9/1979 | Ciarcia et al. | 335/9 |
| 4,503,408 | 4/1985 | Mrenna et al. | 335/35 |
| 4,603,313 | 7/1986 | Shimp et al. | 335/172 |

OTHER PUBLICATIONS

Ronald D. Ciarcia et al., "Circuit Breaker Assembly for High Speed Manufacture", Ser. No. 718,409, filed Apr. 1, 1985.

*Primary Examiner*—Authur T. Grimley
*Assistant Examiner*—Jane K. Lau
*Attorney, Agent, or Firm*—Richard A. Menelly; Walter C. Bernkopf

[57] ABSTRACT

An interchangeable operating mechanism assembly for molded case circuit breakers having a detachable movable contact arm and trip unit assembly allows the same mechanism assembly to be employed across a wide range of breaker ratings. A snap-on common trip bar attachment further allows multiple-pole facility off the common interrupter mechanism assembly. The mechanism assembly is designed to maintain the operating handle in the "on" position upon the occurrence of a welded contact and prevents the mechanism from being reset.

21 Claims, 9 Drawing Figures

INTERCHANGEABLE MECHANISM FOR MOLDED CASE CIRCUIT BREAKER

BACKGROUND OF THE INVENTION

U.S. patent application Ser. No. 718,409 filed Apr. 1, 1985 and entitled "Circuit Breaker Assembly For High Speed Manufacture" describes a circuit breaker design that is assembled in part by automated equipment. It has since been determined that the mechanism design can be made interchangeable with breakers of different ampere ratings by the detachable mounting of the movable contact arm to the mechanism. The trip unit subassembly would be varied for the various breaker ratings while the operating mechanism would be usable for all different ratings.

The purpose of this invention is to describe a molded case circuit breaker operating mechanism that is adaptable for use over a wide range of industrial circuit breaker ratings with only minor modification to the overall breaker assembly.

SUMMARY OF THE INVENTION

An interchangeable circuit breaker operating mechanism for industrial-type molded case circuit breakers employs a detachable movable contact arm arrangement to enable the mechanism to be used within a wide range of industrial ratings. The load terminal strap includes a flux-shunt element to allow the trip unit to be employed within high ampere rated breakers without distortion of the bimetal during short circuit.

BRIEF DESCRIPTION OF THE DRAWINGS

FIG. 4 1s a cutaway side view of the breaker of FIGS. 1–3 with the contacts "blown-open" and the handle in the "on" position;

DESCRIPTION OF THE PREFERRED EMBODIMENT

Figure 1:
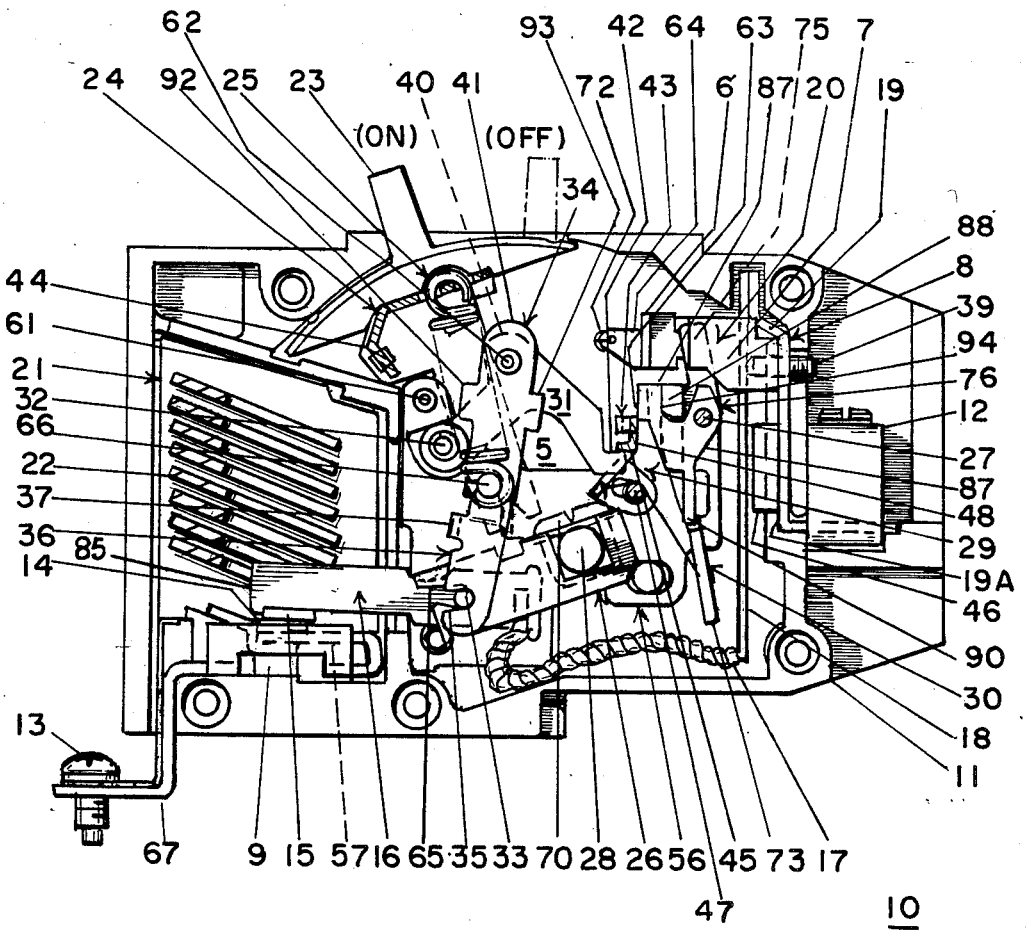
FIG. 1 is a side view of the molded case breaker according to the invention with the contacts closed and the handle i, the "on" position.
Figure 2:
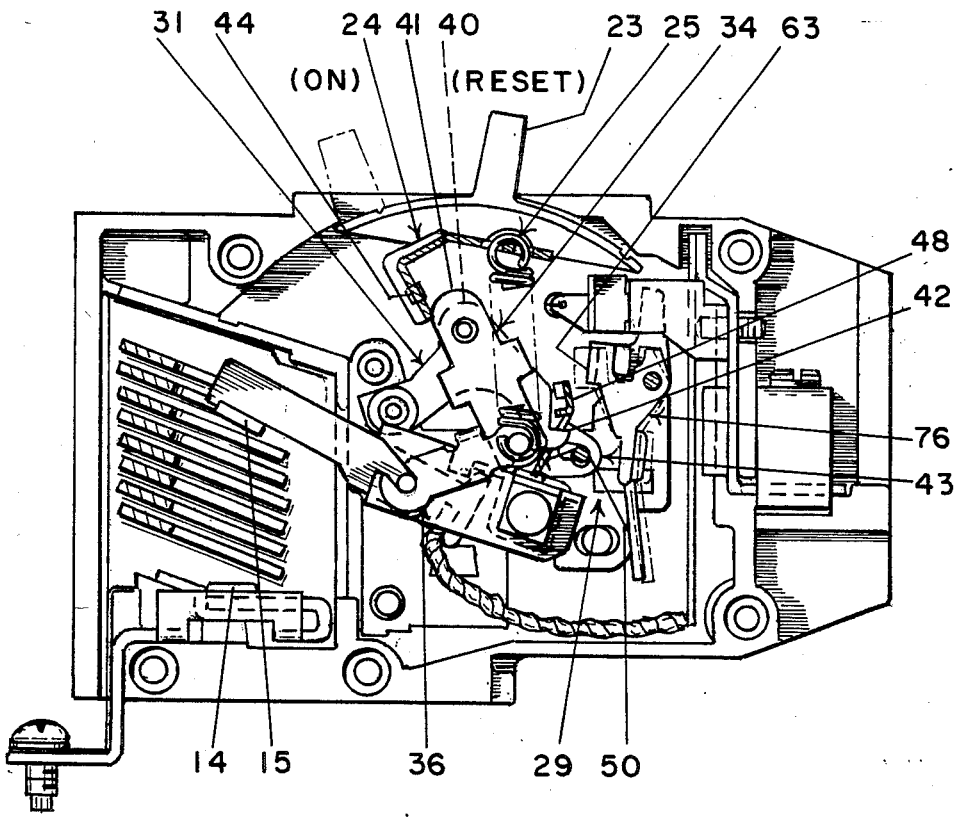
FIG. 2 is a side view of the breaker depicted in FIG. 1 with the contacts open and the handle in the "reset" position.
Figure 3:
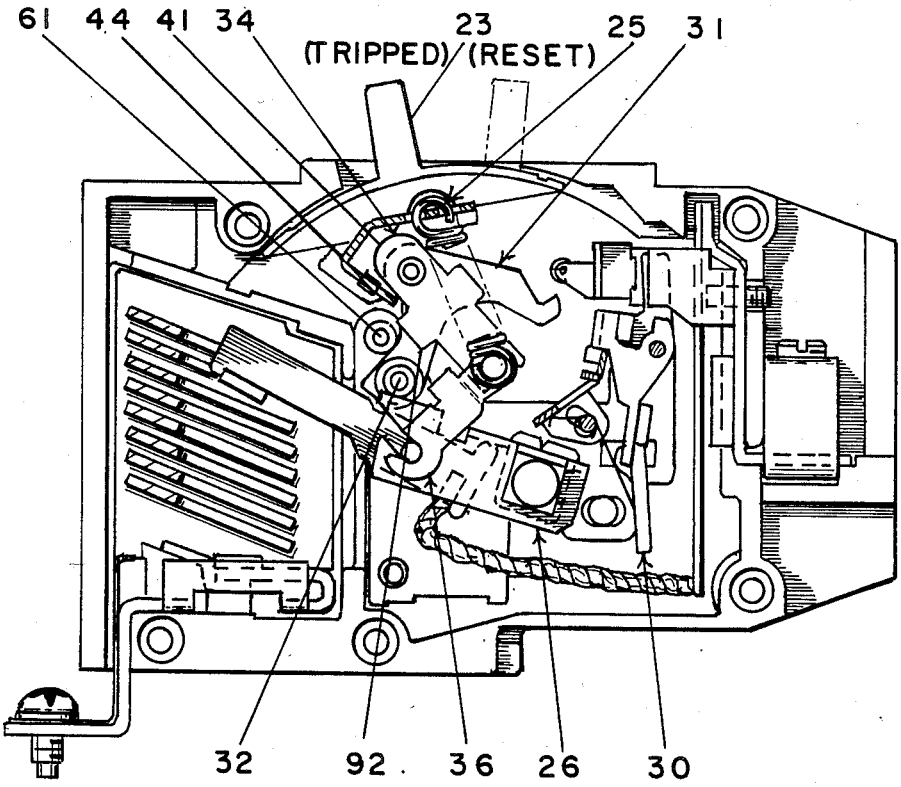
FIG. 3 is a side view of the breaker depicted in FIGS. 1 and 2 with the contacts open and the handle in the "tripped" position.
Figure 4:
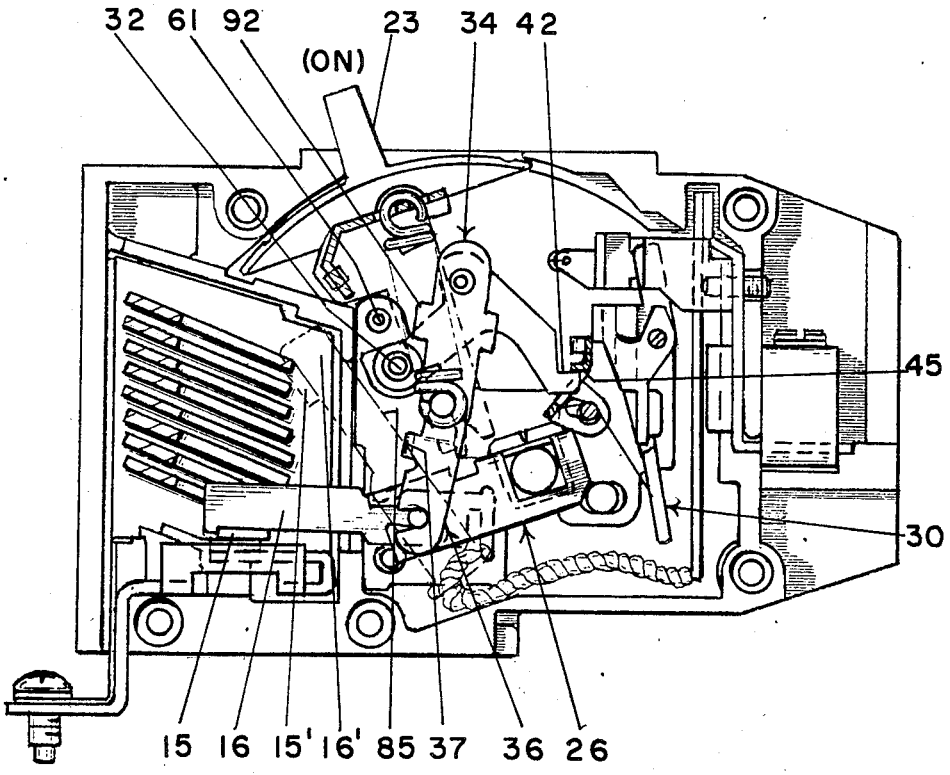
Figure 6:
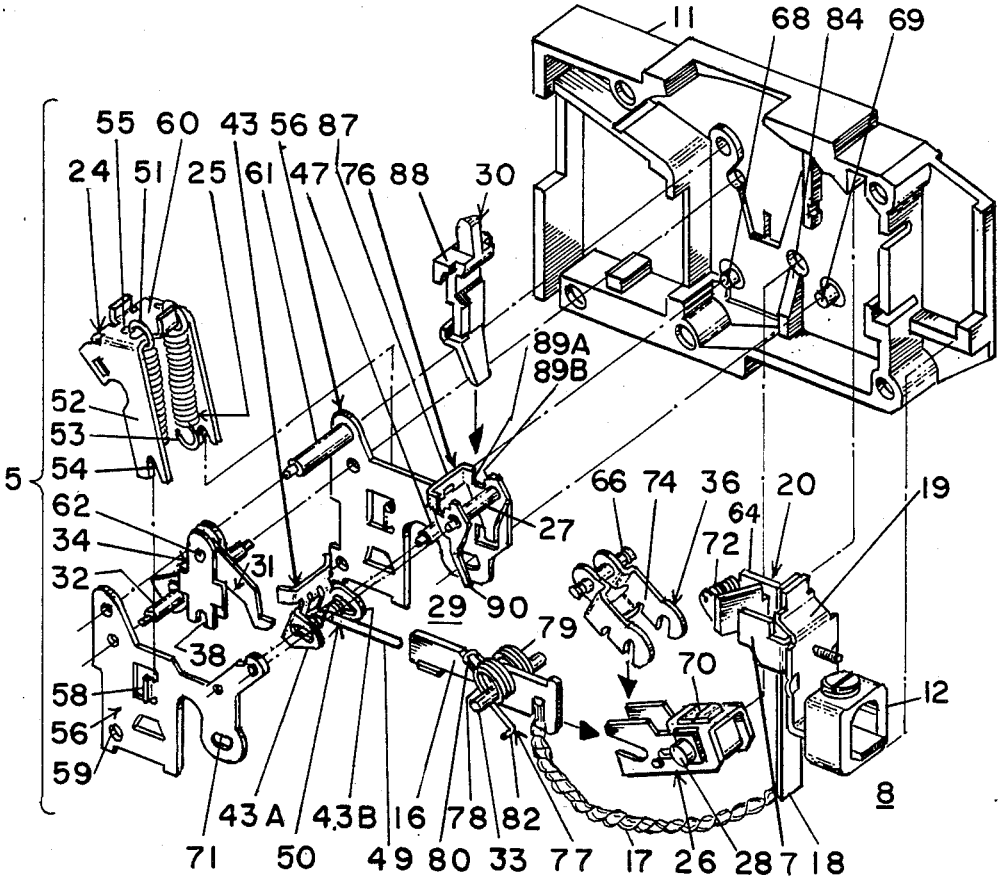
FIG. 6 a front perspective view of the breaker depicted in FIGS. 1–3 is isometric projection.
Figure 7:
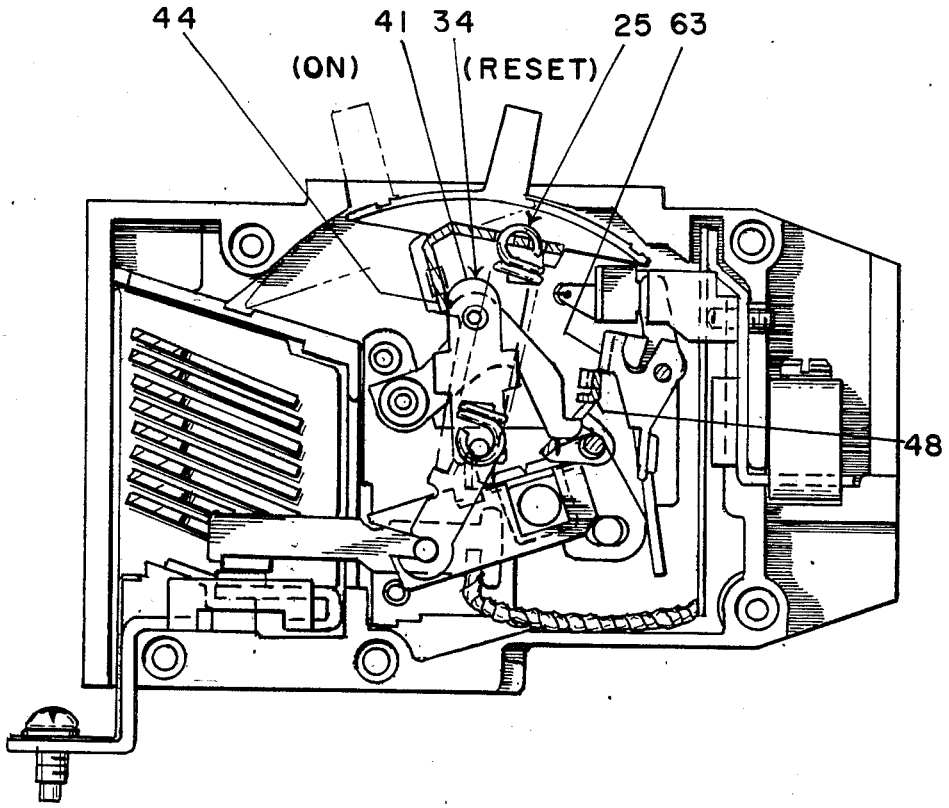
FIG. 7 is a side view of the breaker of FIG. 1 with the contacts welded together and with the handle in the "reset" position.

FIG. 1 contains a molded case single pole circuit breaker 10 of the type used within industrial circuits as illustrated in the "on" position and consisting of a molded case 11 with a load lug 12 at one end and a line strap 67 and line terminal screw 13 at an opposite end thereof. Electrical connection between the line strap and a fixed contact 14 is made by means of a U-shaped end 57 of the line strap 67. The load lug 12 connects with the trip unit bimetal 18 by means of a load strap 19 and connection is made with the movable contact arm 16 by means of braided conductor 17. The trip unit assembly generally indicated at 8 further includes a calibration screw 39 used to calibrate the bimetal 18. The magnetic trip unit 20 consists of a magnet 7 and an armature 6. As disclosed within the referenced U.S. patent application, the operating mechanism assembly generally indicated at 5 interfaces with the trip unit assembly 8 by means of latch assembly 29. A cradle 31 is retained from rotating about its pivot 32 by engagement of a cradle latch surface 42 with a first primary latch surface 45 on a primary latch 43. The primary latch 43 is further restrained from rotating about its pivot 47 by the engagement of a second primary latch surface 48 with a secondary latch surface 63 on the secondary latch 76. The latch assembly 29 responds to the motion of the trip bar 30 when the bottom of the bimetal 18 contacts trip bar leg 73 upon the occasion of an overcurrent condition through the breaker contacts 14, 15. An arc chamber 21 containing a plurality of arc plates 22 is situated at the line terminal end of the case for cooling and extinguishing the arc that occurs when the contacts become separated during such overcurrent conditions. Upon the occasion of a short circuit condition through the contacts, the armature 6, which is biased away from the magnet 7 by a spring 72 best seen in FIG. 6 connected between an armature support 64 and the magnet 7, is rapidly driven towards the magnet and strikes a trip bar projection 75 at the top of the trip bar. The side pivot arrangement between the armature and the magnet allows for magnetic trip function even if the spring 72 failed for some reason. The operating mechanism assembly 5 and the trip unit assembly 8 are both supported within the molded case 11 by means of a pair of side frames 56. The handle yoke 24, which is cut away to show the operating components of the operating mechanism and trip unit assemblies, is also carried by the side frames 56 one of which is also removed to better show the same components. A secondary latch pivot pin 27 extends between both of the side frames 56 to allow free rotation of both the trip bar projection 75 and the trip bar leg 73 during the aforementioned tripping operations. The movable contact arm 16 is slidingly arranged within a slot 65 formed within the contact arm crank 26 and held therein by means of a contact spring 77 better shown in FIG. 6. The crank is mounted on an operational crossbar pivot 28 and held captive by means of staple 70. The trip unit assembly 8 is mechanically attached to the operating mechanism assembly 5 by lower link 36. An ON-OFF handle 23 operatively connects with the movable contact arm 16 by means of handle yoke 24, mechanism springs 25 and upper and lower links 34, 36 as indicated. The slot 35 formed within the lower link during assembly slidingly engages but during operation rotates about a movable contact arm pivot pin 33 pressed through the end of the movable contact arm opposite the movable contact 15. The upper link which has a pair of arms 92, 93 engages the lower link by the sliding engagement of a slot 38 formed in the upper link, better shown in FIG. 6, with the operating springs support pin 66. As further described in the aformentioned U.S. patent application, the upper links comprise a pair of links with the cradle 31 mounted intermediate the pair. The upper link is pivotally connected with the cradle by means of an upper link pivot pin 62. The handle yoke 24 includes a handle lever 44 extending downward for engaging with a top 41 of the upper link 34 to reset the breaker as illustrated in FIG. 2. The handle yoke 24 connects the mechanism springs 25 with the upper and lower links 34, 36 through the operating springs support pin 66. Movement of the handle yoke 24 and the mechanism springs 25 to the left of the upper link pivot pin 62 biases the links to the left and moves the contacts to the closed (breaker on) position. Movement of the handle yoke and mechanism springs to the right of the upper link pivot pin reverses the process and moves the contacts to the open (breaker off) position shown in phantom The reset function shown in FIG. 2 is accomplished by arranging the top 41 of the upper link 34 as the resetting surface and not the top 40 of the cradle 31 which is standard practice. This is a substantial improvement over the arrangement described within the aforementioned U.S. patent application and within other known circuit breaker operating mechanisms. The arrangement of the top of the upper link in contact relation with the handle lever 44 only allows the operating handle 23 to operatively engage the top of the upper link when the contacts are not welded together. This is an important feature since it prevents the handle 23 from resetting the mechanism when the contacts are welded together. In the "welded tripped" condition, as illustrated in FIG. 7, it is noted that the top 41 of the upper link 34 is not rotated sufficiently into position with the handle lever 44 and thereby does not allow the second primary latching surface 48 to become engaged with the secondary latch surface 63 and prevents the mechanism from being reset such that the handle returns to the "ON" position. When the breaker handle 23 is in the tripped position as illustrated in FIG. 3, the handle lever 44 is able to pick up the top 41 of the upper link 34 and move the mechanism springs 25, the cradle 31 and the upper and lower links 34, 36 to the latch resetting condition seen by referring to FIG. 2 by moving the handle to the "RESET" position indicated in phantom provided the contacts are separated. The side opposite the cradle latch surface 42 then engages the first primary latch 43 rotating it counterclockwise sufficiently to allow the secondary latch 76 to rotate counterclockwise under the urging of the secondary latch spring 50 thus presenting the secondary latch surface 63 in the path of primary latch surface 48 such that the breaker can then be closed by moving the handle to the "ON" position indicated in phantom and closing the contacts 14, 15 resulting again in the "ON" condition shown in FIG. 1. With the operating handle 23 in the "ON" position seen by referring to FIG. 4 with the cradle latch surface 42 retained under the first primary latch surface 45, the movable contact arm 16 is capable of moving as indicated at 16' shown in phantom upon the occurrence of a short circuit fault to its "blown-open" position to allow the movable contact 15 to move to 15' before the breaker trip bar 30 is articulated to trip the breaker. Since it is desirable to open the breaker immediately upon the occurrence of such a short circuit fault, the top surface 85 of the movable contact arm 16 strikes the lower link cross arm 37. This impact rapidly moves the lower link 36 in the clockwise direction and forces the upper link 34 and lower link 36 to immediately move to the "OFF" position and then to the tripped position depicted in FIG. 3 after the trip bar 30 releases the latches. This feature is an important advance in circuit breakers of the current limiting blow-open type wherein the movable contact arm operates independently from the rotation of the contact arm crank 26 and simultaneously prevents the contact arm from bouncing back and creating a deleterious contact reclose condition. To prevent the contacts from reclosing after separation, an upper link arm 92 strikes against the cradle stop pin 61 and also serves to accelerate the upper and lower links away from the cradle pivot pin 32 as the cradle 31 rotates counterclockwise.

Figure 5:
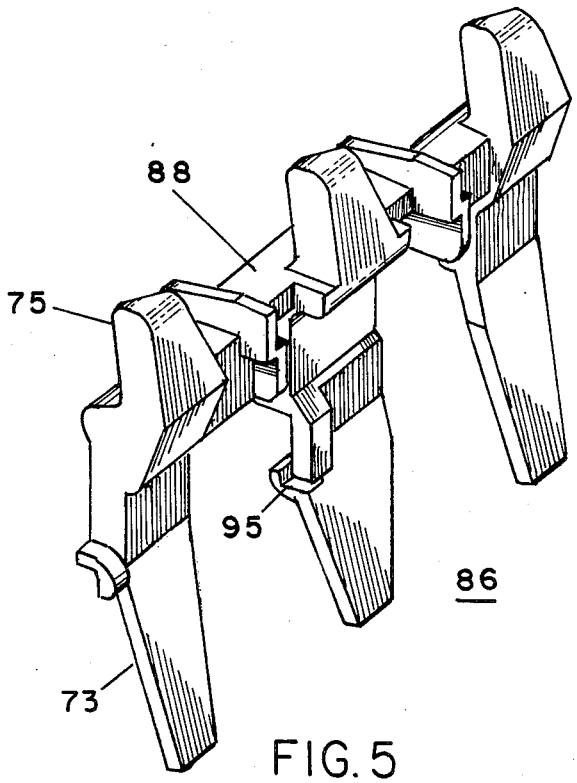
FIG. 5 is a top perspective view of a multiple trip bar unit according to the invention.
Figure 5A:
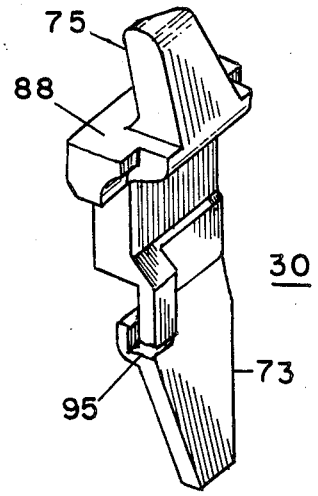
FIG. 5A is a top perspective view of a single trip bar unit according to the invention.

When the circuit breaker is of a multiple pole type a separate contact pair is provided for each individual pole. To prevent so-called "single-phasing", a common multiple trip bar 86 as depicted in FIG. 5 is integrally arranged with each pole having an independent trip bar leg 73 for tripping the mechanism as described earlier with reference to FIG. 1. It is desirable, therefore, to trip all three poles as soon as one of the three poles senses an overcurrent condition. Still referring to the single pole breaker 10 depicted in FIG. 1, a single trip bar 30 is shown attached to the secondary latch yoke 87 by fitting the trip bar cross piece 88 within the slot 94 defined between the front and rear secondary latch pieces 89A, 89B as best seen in FIG. 6. A latch finger 90 forming the bottom of the secondary latch yoke 87 snappingly engages the trip bar 30. The latch finger is retained within a detent slot 95 integrally formed within the side of the trip bar as best seen in FIGS. 5 and 5A. Once the trip bar is assembled to the secondary latch 76, the secondary latch pivot pin 27 allows the trip bar projection 75 and the trip bar leg 73 to rotate clockwise upon contact by the bimetal 18. The arrangement of the multiple trip bar around the center pole, of a three pole breaker is described within U.S. Pat. No. 4,166,988 in the names of Ronald D. Ciarcia et al. and is incorporated herein for describing the operation of a common trip bar to interconnect the three independent trip units within a three pole circuit breaker.

When the breaker is subjected to short circuit overload currents, as described earlier with reference to FIG. 1, a magnetic attraction is immediately generated between the armature 6 and magnet 7 drawing the armature in the direction of the magnet against the bias of armature spring 72 striking the trip bar projection 75 to trip the breaker by moving the secondary latch 76 out of contact with the primary latch 43 and allowing the cradle latch surface 42 to move out from the first primary latch surface 45. However, it has been noted that a strong magnetic field is also generated between the load strap 19 of a non-ferrous metal such as copper and the bimetal 18 since the current transports through both of these conductors in opposite directions. In order to prevent undue distortion of the bimetal, a flux-shunt element 46 of a ferrous material such as steel is interfaced between the load strap and the bimetal preferably by riveting a piece of magetic material onto the interior surface 19A of the load strap. This flux-shunt effectively reduces the magnetic interaction between the bimetal and the load strap by internally shorting out the magnetic lines of force therein.

The method of assembling the breaker components can be seen by referring to FIG. 6. The secondary latch spring 50, which places the latch assembly 29 in position for reset, is positioned between the legs 43A, 43B of the primary latch 43 and placed in position on one of the side frames 56 over primary latch pivot 47 previously attached to the side frame by staking. The secondary latch 76 is positioned over the secondary latch pivot pin 27 also previously staked to the same side frame. The cradle 31 is assembled to the same side frame by means of the cradle pivot 32 along side of the cradle stop pin 61. The cradle is attached to the cradle pivot 32 by a staking process and is connected to the upper links 34 by means of the upper link pivot pin 62. A second side frame 56 is placed in position capturing the opposite ends of all four pins 61, 32, 47, 27 and when staked in place forms the common operating mechanism assembly 5 used within circuit breakers having a wide range of current ratings. The pin staking operation is used for ease of attachment and is not required for breaker performance.

Figure 6A:
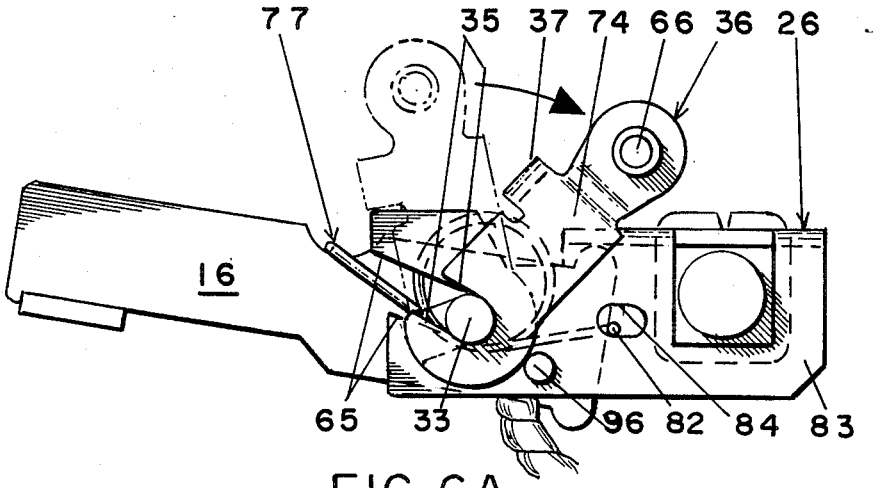
FIG. 6A is a side view of the contact arm depicted in FIG. 6 with the lower links attached.

The trip unit assembly 8, containing the magnetic trip unit 20 and bimetal 18 is attached to the load lug 12 by means of load strap 19 and is electrically connected with the pivot end of the movable contact arm 16 by means of the braided conductor 17. The movable contact arm crank 26 is positioned over the crossbar pivot 28 and held captive by staple 70. The contact spring 77 consisting of turns 78, 79 joined by a crossover 80 and having opposing right angled spring legs 82, only one of which is visible, is placed over the movable contact arm 16 and the movable contact arm pivot pin 33 extended through the movable contact arm and through the contact spring. The arm, spring, and pin are next inserted within the slots 65 formed within the movable contact arm crank yokes 83 as best seen in FIG. 6A and the entire assembly consisting of the movable contact arm and crank are all held together by the passage of the spring legs 82 through a pair of holes 84 formed through the crank yokes 83 on both sides of the crank 26. The lower link 36 is positioned on the crank as shown in phantom capturing the movable contact arm pivot pin 33 within the slots 35 formed at the ends of the two lower link arms 74 and upon clockwise rotation the link and pin are retained by means of a pair of posts 96 extending from both sides of the crank 26 only one of which is shown. The lower link crossarm 37 sets the spacing between the lower link arms to complete the assembly.

The operating mechanism assembly 5 is then attached to the trip unit assembly 8 by positioning the upper link slots 38 over the operating springs support pin 66 extending through the tops of the lower link arms 74 as seen by referring back to FIG. 6. The V-shaped slots 54 formed on the bottom of the legs 52 of the handle yoke 24 are placed over the support tabs 58 formed within both of the side frames 56. The bottom hooks 53 of the mechanism springs 25 are positioned over the operating springs support pin 66 and the top hooks 51 are engaged within the slots 55 formed within the crosspiece 60 of the handle yoke. The trip bar 30 is then inserted between the legs of the secondary latch 76 until the trip bar crosspiece 88 rests in the notches bounded by surfaces 89A, 89B and the arm 49 of the secondary latch spring 50 is rotated preloading the secondary latch spring 50 to complete the assembly. The assembled side frames 56, containing the handle yoke 24, lower links 36, upper links 34, movable contact arm crank 26, and movable contact arm 16 are attached to the case by the placement of holes 59, 71 formed in both of the side frames over the support posts or projections 68, 69 extending from the inner surface on both sides of the case 11. The movable contact arm assembly is next positioned within the case by insertion of the crossbar pivot 28 within the openings 84 formed in the sides of the case.

The arrangement of the trip unit assembly 8, contact arm crank 26 and cross bar pivot 28, upper link 34, and trip bar 30 being detachable from the operating assembly 5 thereby allows a common operating mechanism subassembly to be used over a wide range of breaker ratings by simply designing each of the aforementioned current carrying components in proportion to the current rating. This greatly facilitates the assembly of the circuit breaker 10 as well as substantially reducing the number of component parts formally required wherein each rated breaker required a separate operating mechanism.

Having described out invention what we claim as new and desire to secure by Letters Patent is:

1. An operating mechanism for a molded case circuit breaker of the type consisting of a trip unit arranged in series with a fixed contact and a movable contact said operating mechanism comprising in combination:

a U-shaped handle yoke for supporting an operating handle and a pair of operating springs;

a pair of opposing side frames separated by means of a cradle stop pin;

a knee-shaped cradle member pivotally arranged intermediate said side frames and mounted on a cradle support pivot at one end perpendicularly extending betewen said side frames;

an upper link member pivotally attached to said cradle member on an upper link pivot intermediate said cradle support pivot and a cradle hook on said cradle at an opposite end from said cradle support pin;

a latch assembly comprising a primary latch and a secondary latch, said primary latch engaging with said cradle hook and said secondary latch being pivotally arranged at a top end intermediate said side frames for interaction with said trip circuit by means of a trip bar arranged at a bottom end of said secondary latch;

a lower link member pivotally arranged intermediate a movable contact arm carrier, comprising a pair of slotted yoke members arranged on a crossbar pivot, and said upper link, said operating springs connecting between said U-shaped handle yoke and said lower link for moving said upper link and said lower link to ON and OFF positions in response to movement of said operating handle; and a movable contact arm supporting a movable contact, said movable contact arm terminating at a pin at one end opposite from said movable contact, said pin being captured within said pair of slots at an end of said movable contact arm carrier supporting said movable contact arm and allowing said movable contact arm to rotate independent of said movable contact arm carrier, said lower link member including a slot at one end for arranging over a pin in said movable contact arm end and said movable contact arm carrier.

2. The operating mechanism of claim 1 wherein said movable contact arm carrier includes an additional pair of protrusions extending therefrom and capturing said lower link slotted end against said movable contact arm pin.

3. The operating mechanism of claim 1 wherein said lower link slots lockingly retain said contact arm pin.

4. The operating mechanism of claim 1 wherein a top of said upper link extends a greater distance than a top of said cradle knee for contacting a lever extending from said U-shaped handle yoke and moving said cradle hook into re-set engagement with said primary latch.

5. The operating mechanism of claim 1 wherein said secondary latch comprises a pair of yoke members joined by a planar latching surface.

6. The operating mechanism of claim 5 further including a removable trip bar having a body member including a top projection for interacting with a magnetic trip element and a bottom projection for interacting with a thermal trip element.

7. The operating mechanism of claim 6 wherein said trip bar further includes a pair of side projections for nesting within said secondary latch yoke members.

8. The operating mechanism of claim 7 wherein said trip bar includes a recess on one side for receiving an extension on one of said yoke members for snappingly engaging said yoke extension.

9. The operating mechanism of claim 7 wherein said removable trip bar further includes extension means for providing multi-pole operation within a single circuit breaker.

10. The operating mechanism of claim 7 further including a secondary latch pivot pin extending between said opposing side frames for supporting a secondary latch spring, said secondary latch spring having a first arm biasing said primary latch toward said secondary latch and a secondary arm biasing said secondary latch toward said primary latch.

11. The operating mechanism of claim 10 wherein said second arm further biases said trip bar to a reset position.

12. An operating mechanism for a molded case circuit breaker of the type consisting of a trip unit arranged in series with a fixed contact and a movable contact, said operating mechanism comprising in combination:

A U-shaped handle yoke for supporting an operating handle and a pair of operating springs;

a pair of opposing side frames separated by means of a cradle stop pin;

a knee-shaped member pivotally arranged intermediate said side frames and mounted on a cradle support pivot at one end perpendicularly extending between said side frames;

an upper link member pivotally attached to said cradle member on an upper link pivot intermediate said cradle support pivot and a cradle hook on said cradle at an opposite end from said cradle support pin;

a latch assembly comprising a primary latch and a secondary latch, said primary latch engaging with said cradle hook, and said secondary latch being pivotally arranged at a top end intermediate said side frames for interaction with said trip circuit by means of a trip bar arranged at a bottom end of said secondary latch; and a lower link member pivotally arranged intermediate a movable contact arm carrier, comprising a pair of slotted yoke members arranged on a crossbar pivot, and said upper link, said operating springs connecting between said U-shaped handle yoke and said lower link for moving said upper link and said lower link to ON and OFF positions in response to movement of said operating handle, said upper link having a cruciform configuration whereby a rear arm strikes said cradle stop pin and accelerates said upper link and said lower link away from said cradle stop pin to prevent said contacts from reclosing after an overcurrent condition through said contacts.

13. An operating mechanism for a molded case circuit breaker of the type consisting of a trip unit arranged in series with a fixed contact and a movable contact, said operating mechanism comprising in combination:

a U-shaped handle yoke for supporting an operating handle and a pair of operating springs a pair of opposing side frames separated by means of a cradle stop pin;

a knee-shaped cradle member pivotally arranged intermediate said side frames and mounted on a cradle support pivot at one end perpendicularly extending beween said side frames;

an upper link member pivotally attached to said cradle member on an upper link pivot intermediate said cradle support pivot and a cradle hook on said cradle at an opposite end from said cradle support pin;

a latch assembly comprising a primary latch and a secondary latch, said primary latch engaging with said cradle hook, and said secondary latch being pivotally arranged at a top end intermediate said side frames for interaction with said trip circuit by means of a trip bar arranged at a bottom end of said secondary latch;

a lower link member pivotally arranged intemediate a movable contact arm carrier, comprising a pair of slotted yoke members arranged on a crossbar pivot, and said upper link, said operating springs connecting between said U-shaped handle yoke and said lower link for moving said upper link and said lower link to ON and OFF positions in response to movement of said operating handle;

a load strap connecting with said strip unit, said load strap comprising a planar conductor having a surface facing a bimetal on said trip unit; and flux shunt means on said planar conductor surface intermerdiate said bimetal and said load strap reducing magnetic field effects on said bimetal upon short circuit current transport through said trip unit.

14. The operating mechanism of claim 13 wherein said load strap comprises a non-ferrous metal and said flux shunt comprises a ferrous metal.

15. A molded case circuit breaker comprising:

a molded plastic case supporting a line terminal, line terminal strap, arc chute and fixed contact at one end and a load terminal, load terminal strap and trip unit at an opposite end;

an operating mechanism arranged on a contact arm carrier inermediate said arc chute and said trip unit, said operating mechanism comprising:

an operating yoke on a pair of side frame carrying a cradle, upper link, primary and secondary latches, a pair of operating springs and a removable lower link connecting between said upper link and said contact carrier, said contact carrier including a pair of slotted arms for capturing a pin on one end of a movable contact arm opposite a movable contact at an opposite end, said movable contact arm being rotatable about said pin independent of rotation of said contact carrier.

16. The molded case circuit breaker of claim 15 wherein said trip unit includes both magnetic and thermal responsive trip elements, said magnetic trip element comprising a magnet attached to said load strap and said magnet including a pair of arms extending from said load strap, one of said arms being slotted for receiving a tab extending from an armature, said armature being biased away from said magnet by means of an armature spring.

17. The molded case circuit breaker of claim 16 wherein said load strap further supports said thermal responsive trip element and includes a magnetic shunt intermediate said thermal element and said load strap for protecting said thermal element against magnetic distortion.

18. The molded case circuit breaker of claim 15 wherein said load terminal strap comprises a planar metal conductor having a surface facing said trip unit and including a flux shunt member on said surface for decreasing magnetic effects on said trip unit upon short circuit current transport through said trip unit.

19. The molded case circuit breaker of claim 18 wherein said cradle comprises a knee-shaped member rotatably mounted to said side frames by means of a cradle pivot at one end of the knee and supporting a cradle hook at an opposite end therof.

20. The molded case circuit breaker of claim 19 wherein a top of said upper link extends above said cradle knee for receiving an extension on said handle yoke and moving said cradle hook into latching engagement with said primary latch for moving said operating springs into an over-center condition and said movable contact arm in a counter-clockwise direction after said movable and fixed contact arm are separated by over-current operation of said operating mechanism whereby said upper link is unable to receive said extension on said handle yoke to move said cradle hook into latching engagement with said primary latch when said movable contact is welded to said fixed contact.

21. The molded case circuit breaker of claim 18 wherein said upper link comprises a pair of cruciform members rotatably connected to a cradle by means of a pivot pin.

* * * * *